United States Patent [19]

Harbeke

[11] Patent Number: 4,918,761

[45] Date of Patent: Apr. 24, 1990

[54] METHOD OF USING A TOILET-FLANGE CAST-IN MOUNT

[76] Inventor: Gerold J. Harbeke, 2807 S. Military Trail, West Palm Beach, Fla. 33415

[21] Appl. No.: 201,147

[22] Filed: Jun. 2, 1988

[51] Int. Cl.[5] ..... E03D 11/16

[52] U.S. Cl. ..... 4/252 R; 249/39; 285/56; 52/220; 52/232

[58] Field of Search ..... 205/56, 58, 59, 60, 205/177; 4/252 R, 191, DIG. 7; 285/64; 249/39, 207; 521/220, 221, 232

[56] References Cited

U.S. PATENT DOCUMENTS

| | | | |
|---|---|---|---|
| 1,793,681 | 2/1931 | Crowell | 285/58 |
| 3,339,215 | 9/1967 | Flood | 4/252 |
| 3,421,551 | 1/1969 | Currier | 138/178 |
| 3,479,060 | 11/1969 | Westbrook et al. | 285/58 |
| 3,967,326 | 7/1976 | Tammen | 4/252 |
| 3,967,836 | 7/1976 | Izzi, Sr. | 4/252 R |
| 4,052,759 | 10/1977 | Hill | 4/252 R |
| 4,109,327 | 8/1978 | Jones | 4/252 R |
| 4,233,697 | 11/1980 | Cornwall | 4/252 R |
| 4,261,598 | 4/1981 | Cornwall | 285/56 |
| 4,364,210 | 12/1982 | Fleming et al. | 285/187 |
| 4,453,354 | 6/1984 | Harbeke | 52/220 |
| 4,482,161 | 11/1984 | Izzi, Sr. | 4/252 R |
| 4,488,388 | 12/1984 | Schmidt | 52/221 |
| 4,623,170 | 11/1986 | Cornwall | 52/221 |
| 4,630,415 | 12/1986 | Attwell | 285/189 |
| 4,638,829 | 1/1987 | Cornwall | 4/252 R |
| 4,648,139 | 3/1987 | Stokes | 4/252 R |
| 4,669,759 | 6/1987 | Harbeke | 52/220 |
| 4,730,854 | 3/1988 | Cuscheron | 285/58 |
| 4,800,926 | 1/1989 | Beck | 52/221 |
| 4,823,411 | 4/1989 | Nettel | 4/255 |

FOREIGN PATENT DOCUMENTS

| | | | |
|---|---|---|---|
| 2108614 | 5/1983 | United Kingdom | 285/187 |

*Primary Examiner*—Henry J. Recla
*Assistant Examiner*—Edward C. Donovan
*Attorney, Agent, or Firm*—Griffin, Branigan & Butler

[57] ABSTRACT

A method of using a toilet-flange cast-in mount (10) that has a bottom end portion (16) which is of a female pipe coupling size for coupling with a three inch pipe (24) and a top end portion (18) of a four inch pipe size. The toilet-flange cast-in mount has an intumescent-material collar (26) at its bottom end portion for closing the bottom end portion and the three inch pipe coupled therewith. The top end portion can be mated with a toilet flange (38) having a mounting stub portion (40) with an outer diameter of four inches.

6 Claims, 1 Drawing Sheet

METHOD OF USING A TOILET-FLANGE CAST-IN MOUNT

BACKGROUND OF THE INVENTION

This invention relates broadly to toilet flanges, and more specifically to a toilet flange mount which is cast-in, or embedded, in a concrete floor.

In the past, pipes were extended through floors of buildings after concrete floors were poured. In this respect, void-forming devices were used during the "pouring" of the floors to create holes through which pipes were extended. In some cases, holes were bored, or pounded through the floors after they were formed and the pipes were then extended through these holes. Normally, the holes were made to be bigger than the pipes to ensure that one could put pipes easily through them. Thereafter, it was necessary for workmen to fill spaces between the pipes and the holes with concrete, or some other substance, in order to meet fire codes which generally do not allow holes in floors.

In the case of mounting toilet flanges, the pipes were extended up through floor barriers from the story below and terminated at about the upper surfaces of the floor barriers. Pipe flanges were then mounted on top ends of the pipes and toilets were mounted on the flanges. In this respect, standard pipe flanges today are made to fit on either four inch or three inch pipes (these dimensions refer to internal diameters), with some pipe flanges being made to fit on either size, being inserted into a four inch pipe and being mounted on the outside surface of a three inch pipe.

At least one person has suggested mounting a special pipe coupling on a concrete form and pouring concrete around the pipe coupling. Once the concrete has hardened and the form removed, a toilet flange is mounted on the upper end of the coupling. Such an arrangement is shown in U.S. Pat. No. 4,453,354 to Harbeke. Further, several people have suggested "casting in" toilet flanges with cast-in couplings. Once such cast-in toilet flange is shown in Cornwall (U.S. Pat. No. 4,261,598).

As mentioned above, in the prior art, toilet flanges are made to fit directly on pipes. Some toilet flanges fit on four inch pipe and other toilet flanges fit on three inch pipe. Some toilet flanges are made to be mounted inside four inch pipe but on the outside of three inch pipe. That is, they have tubularly-shaped mounting stubs which have outside diameters of four inches to fit inside four inch pipes and inside diameters of three and one half inches to fit on the outsides of three inch pipes. In those cases where cast-in couplings have been used for toilet flanges, the coupling shave been for coupling the same size pipes or flanges at opposite ends thereof and the toilet flanges were of sizes for mating with the pipes attached to the couplings.

A difficulty involving the use of plastic pipe, and particularly cast-in couplings for plastic pipes, is that the plastic pipes, when there is a fire, will melt, thereby providing openings through building floor barriers for fires to move between floors. It has been suggested in the past to surround such plastic pipes with collars of intumescent material which expand when subjected to heat from fires, thereby closing off pipe strings at the floor barriers and not allowing fires to move between floors. Difficulties in providing and using toilet-flange mounting systems in the past have been that when prior art cast-in couplings for three inch pipe were used, three inch toilet flanges, which had to be mounted on the outsides of three inch pipes so that the openings into the three inch pipes would not be reduced, had to be used. In order to do this, it has been necessary to wrap upper ends of the three inch pipes, prior to casting them in concrete, with a frangible material which could be removed to leave spaces for three inch toilet-flange coupling stubs to be placed about the cast-in pipes. Alternatively, if one did not use such spacers, one would have to chip out around the cast-in pipes to make room for the externally-mounted, three inch, toilet-flange mounting stubs. Both of these procedures are time consuming and therefore expensive. Alternately, when one uses four inch cast-in pipe couplings and pipes, one must use enough intumescent material to close off four inch pipes which is considerably more intumescent material than is required to close off three inch pipes. This drives up the cost of producing such toilet-flange cast-in coupling assemblies. It is an object of this invention to provide a toilet-flange cast-in amount which does not require the use of a spacer or chipping away concrete at an upper end, but which also does not require the use of an undue amount of intumescent material at its lower end.

It is an object of this invention to provide a toilet-flange cast-in mount which is easy to mount to a form.

SUMMARY

A toilet-flange cast-in mount has a lower end tubular portion of the shape and size of a female three inch pipe coupler and an upper end portion which is of a size of a four inch pipe. That is, the lower end portion has an internal diameter of approximately three and one half inches and an external diameter of approximately four inches and the top end portion has an external diameter of approximately four and one half inches and an internal diameter of approximately four inches. The bottom end portion has mounted thereon an intumescent-material collar and a protective annular rib or flange extends above the intumescent collar to protect the top end of the collar. This intumescent collar is of a type to be used with female couplers for three inch pipes. Thus, a toilet-flange for use with a four inch pipe can be mounted at the top end of the toilet-flange cast-in mount but only an intumescent collar for a three inch pipe is needed at its lower end.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE DRAWINGS

Figure 1:
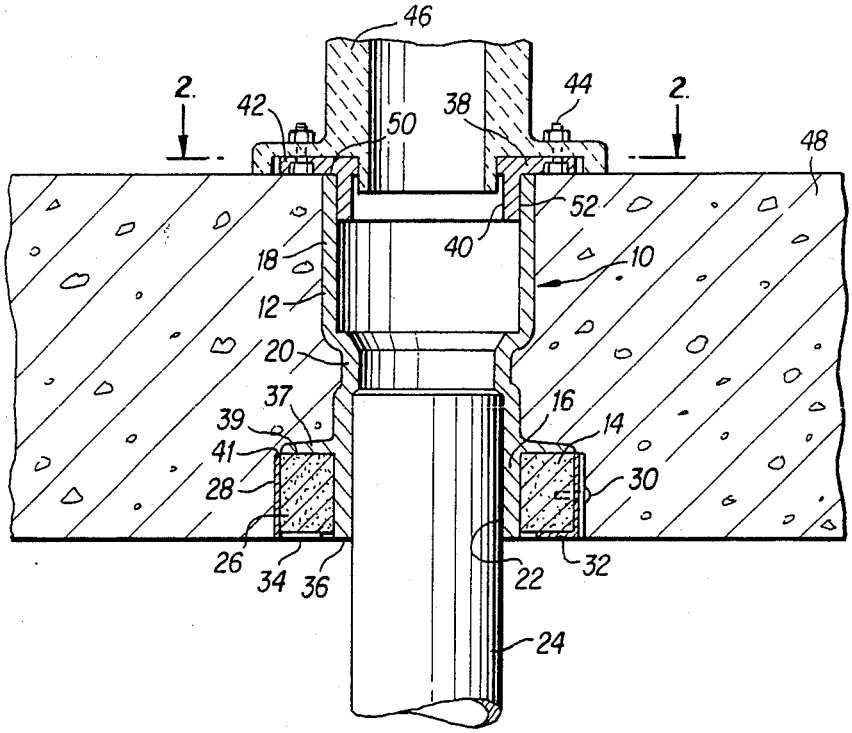
FIG. 1 is a side sectional view of a toilet flange cast-in mount of this invention embedded, or cast into, a concrete floor with a pipe mounted at its lower end, and a toilet flange and toilet base mounted at its top end; and, FIG. 2 is a cross sectional view taken on lines 2—2 of FIG. 1.

A toilet-flange cast-in mount 10 comprises a cast, one-piece, tubularly-shaped member 12 and an intumescent collar 14.

The tubularly-shaped member 12 is constructed of a plastic of which pipe is normally constructed, such as PVC or ABS, to have a bottom end portion 16 and a top end portion 18, these two portions being divided by an internal shoulder 20.

The bottom end portion 16 is basically a round tubular wall defining a round bore 22 which is three and one half inches in diameter, that is, it is basically the size of an outer surface of a three inch pipe (a pipe with an inner diameter of three inches and an outer diameter of three and a half inches). Thus, the bottom end portion 16 is basically a female coupling for a three inch pipe.

The top end portion 18, on the other hand, is formed of a round tubular wall which is of a size and shape of a four inch pipe; that is, it has an internal diameter of four inches and an external diameter of four and one half inches.

The shoulder 20 contacts the end of a three inch pipe 24 which is inserted into the bore 22 of the bottom end portion 16.

The intumescent collar 14 comprises one wrap, or a plurality of wraps, of intumescent material 26 which is/are frictionally clamped about the outer surface of the bottom end portion 16 by a metallic strip 28 whose ends are pivoted, screwed, or otherwise attached together by a fastener 30. The metallic strip 28 only partially covers a bottom end of the intumescent collar 26 at radially-directed, bent-in, tabs 32. A bottom end 34 of the intumescent collar 26 is located adjacent a bottom end 36 of the bottom end portion 16 of the tubulary-shaped member 12. A top end of the intumescent collar 14 abuts an annular rib, or flange, 37 which is cast as one piece with the tubularly-shaped member 12 for protecting a top end edge 39 of the intumescent material 26 from water and dust. A ¼ inch space is left between an upper end edge 41 of the metallic strip 28 and the top end edge 39 of the intumescent material 26 so that heat is inhibited from going from the metallic strip 28 around the intumescent material to melt the tubulary-shaped member 12 above the intumescent collar 14.

Figure 2:
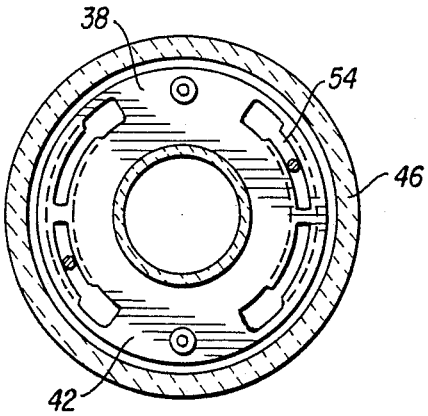

A four/three inch toilet-flange 38 has a round tubular mounting stub portion 40 and a flange portion 42. The toilet flange 38 is constructed of a PVC plastic or some other plastic of which pipe is made. The mounting-stub portion 40 of the toilet flange 38 has an outer diameter of four inches and an inner diameter of three and one half inches, thus, the mounting stub portion 40 fits snugly inside in the top end portion 18 of the four-inch tubularly-shaped member 12. The flange portion 42 has various slots and holes therein, as can be seen in FIG. 2, for using mounting bolts 44 to mount a toilet base 46 to the flange portion 42.

In use of the toilet-flange cast-in mount 10, this member is removably attached to a concrete form (not shown) for casting a floor of a building with its bottom end 36 being held tightly against an upper surface of the form. Various means are available for holding such a cast-in mount, or coupling, to a concrete form, and it is not thought necessary to describe such a fastening system in detail here. One such system is described in U.S. Pat. No. 4,642,956 to Harbeke, and other systems are described in U.S. applications which have been subsequently filed by Harbeke. Since the bottom end 36 is tightly held against the concrete form, the bottom end 34 of the intumescent collar is also held tightly against the form. Thereafter, concrete 48 is poured in the form to a level of a top end 50 of the top end portion 18 and allowed to cure. In this regard, the top end portion 18 of the tubularly-shaped member 12 can be made of a length which makes the tubuarly-shaped member 12 as long as the greatest thickness of a floor with which it could be used. When the thickness of the floor with which it is to be used is known, the top end portion 18 is cut to make the tubularly-shaped member 12 the same length as the floor thickness. The concrete is then allowed to cure and the concrete forms are removed. Thereafter, a dissolving type adhesive is placed on an outer surface 52 of the mounting stub 40 of the toilet flange 38 and the mounting stub 40 is pressed down into the top end of the tubulary-shaped member 12. Once the adhesive has hardened, the toilet-flange 38 is basically a part of the top end portion 18. Heads of bolts 44 are then placed in enlarged portions of slots 54 in the flange portion 42 of the toilet-flange 38 and moved laterally into smaller portions of the slots. Thereafter, the toilet base 46 is fastened to the flange portion 42 by means of nuts which are tightened onto the bolts 44 as is depicted in FIG. 1.

It can be appreciated by those of ordinary skill in the art that it was not necessary to prepare the toilet-flange cast-in mount 10 with a frangible collar at its upper end to leave a space thereabout for mounting the toilet-flange 38, inasmuch as since the top end portion 18 is the size of a four inch pipe the toilet-flange 38 can be mounted on the inside thereof. However, it will also be appreciated by those of ordinary skill in the art that inasmuch as the bottom end portion 16 of the toilet-flange cast-in mount is of a size of a female coupler for a three inch pipe, this end of the pipe need only be wrapped with an intumescent collar 14 for closing off three inch pipe and not four inch pipe. Both of these features are extremely beneficial inasmuch as they do not require undue time and material creating a space about a three inch pipe and in that they do not require an undue amount of intumescent material. In this respect, it is currently estimated that the toilet-flange cast-in mount of this invention saves about $15.00 in intumescent material for each mount by allowing a three-inch-pipe intumescent collar to be used as opposed to a four-inch-pipe collar.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed are defined as follows:

1. A method of installing a toilet flange in a building, said method comprising the steps of:

casting a one-piece, tubularly-shaped mount having a bottom end portion with an inside diameter of the size and shape of a female coupling for three inch pipe and a top end portion with an inside diameter of four inch pipe, said bottom end portion defining approximately a three and one half inch internal diameter bottom opening for receiving a three inch pipe and said top end portion defining approximately a four inch internal diameter top opening for receiving a four inch external diameter tubularly-shaped stub of a toilet-flange therein, said top end portion being substantially longer than said bottom end portion and being of such a length as to make the overall length of said mount greater than the thickness of a concrete floor in which said mount is to be embedded;

attaching said mount to a form for casting said concrete floor with said bottom end portion being adjacent said form;

casting a concrete floor in said form about said mount with the bottom opening exposed on the bottom of the floor and with the top opening exposed on the top of the floor;

cutting off said top end portion a sufficient amount so that said mount has a length corresponding to a thickness of the cast concrete floor;

inserting a three inch pipe into a bottom opening and affixing it to the bottom-end portion and inserting a tubularly shaped stub of a toilet-flange into the top opening, said tubularly-shaped stub having approximately a four inch external diameter of substantial length matching the internal diameter of said top end portion; and wrapping an intumescent-material collar for closing off three inch pipe in a three inch female coupler about the bottom end portion at a bottom end thereof and casting it into said concrete floor with said mount for expanding and thereby closing off said bottom end portion and the three inch pipe mounted therein when it is exposed to the heat of a fire.

2. A method as in claim 1, wherein the step of fabricating said one-piece tubularly shaped mount further includes the substep of fabricating a protective external rib to be above, and abut, a top end of the intumescent material collar for protecting the top-end thereof.

3. A method as in claim 2, wherein the step of fabricating said one-piece, tubularly-shaped mount further includes the substep of fabricating an internal shoulder in said tubularly-shaped member for contacting said three inch pipe inserted into the bottom opening for preventing the pipe from being slid further onto the tubularly-shaped member.

4. A method as in claim 1, wherein the step of fabricating said one-piece, tubularly-shaped mount further includes the substep of fabricating an internal shoulder in said tubularly-shaped member for contacting a three inch pipe inserted into the bottom opening for preventing the pipe from being slid further into the tubularly-shaped member.

5. A method as in claim 1 wherein said cutting off step is carried out after said mount is attached to said form and said concrete floor has hardened thereabout.

6. A method as in claim 1 wherein said wrapping step is carried out before said mount is attached to said form.

* * * * *